US005829559A

United States Patent [19]

Nordstrom et al.

[11] Patent Number: 5,829,559

[45] Date of Patent: Nov. 3, 1998

[54] ARTICLE FOR ATTACHING AN ITEM TO LUGGAGE

[75] Inventors: Mark Nordstrom, Brentwood, Tenn.; James E. O'Shea, Jr., Annandale, N.J.

[73] Assignee: Hartmann Luggage Company, Lebanon, Tenn.

[21] Appl. No.: 665,722

[22] Filed: Jun. 18, 1996

[51] Int. Cl.[6] ..... A45C 5/14; A45C 13/26; A45C 13/28; A45C 13/30

[52] U.S. Cl. ..... 190/102; 190/108; 190/115

[58] Field of Search ..... 150/109, 111; 190/18 A, 39, 27, 101, 102, 115

[56] References Cited

U.S. PATENT DOCUMENTS

| | | | |
|---|---|---|---|
| 676,310 | 6/1901 | Goldberg | 190/102 |
| 699,790 | 5/1902 | Collins | 190/27 |
| 1,084,360 | 1/1914 | Rahm | 190/108 |
| 1,643,106 | 9/1927 | Williams | 190/101 |
| 2,581,417 | 1/1952 | Jones | 190/19 A X |
| 3,958,731 | 5/1976 | Riedle | 190/108 X |
| 4,068,786 | 1/1978 | Taniguchi | 150/109 X |
| 4,094,391 | 6/1978 | Ratchford | 190/18 A |
| 4,424,841 | 1/1984 | Smith | 190/108 X |
| 4,538,709 | 9/1985 | Williams et al. | 190/18 A |
| 4,738,341 | 4/1988 | Asano | 190/101 |
| 4,759,431 | 7/1988 | King et al. | 190/18 A |
| 4,995,436 | 2/1991 | Cantor | 190/101 X |
| 5,240,106 | 8/1993 | Plath | 190/108 X |
| 5,311,972 | 5/1994 | Plath | 190/102 |
| 5,323,886 | 6/1994 | Chen | 190/18 A |
| 5,355,980 | 10/1994 | Hsieh | 190/115 |
| 5,501,308 | 3/1996 | King | 190/102 |
| 5,560,458 | 10/1996 | Franklin et al. | 190/102 X |

FOREIGN PATENT DOCUMENTS

| | | | |
|---|---|---|---|
| 315595 | 11/1919 | Germany | 190/102 |
| 327545 | 4/1930 | United Kingdom | 190/102 |
| 396926 | 8/1933 | United Kingdom | 190/102 |
| WO 95 19117 | 7/1995 | WIPO . | |

*Primary Examiner*—Sue A. Weaver
*Attorney, Agent, or Firm*—Eckert Seamans Cherin & Mellott

[57] ABSTRACT

An article for attaching an item to a wheeled suitcase includes a flexible member or strap with one end removably attached to a handle of the suitcase and the other end carrying a collapsible hook, suspended from the handle for holding an auxiliary item such as a briefcase. Attachment at the handle includes a plug and socket that permit rotation relative to the handle without risking disengagement of the plug from the socket when tension on the strap pulls the plug downwardly. The hook has two interlinked members and is secured to the flexible member such that the hook opens when suspended due to tension from the hook's own weight.

24 Claims, 4 Drawing Sheets

ARTICLE FOR ATTACHING AN ITEM TO LUGGAGE

FIELD OF THE INVENTION

This invention relates to luggage accessories, and more particularly, to articles for temporarily attaching auxiliary items to suitcases, for transport.

BACKGROUND

Luggage, such as suitcases for articles of clothing, personal items, and the like, are sometimes equipped with wheels, which are mounted on the luggage. Wheeled luggage generally includes a handle which is often extendable from the periphery of the luggage. The user grasps the handle and is able to wheel the luggage with relative ease by either pushing it along or wheeling it behind as the user walks.

To take further advantage of the convenience of wheeled luggage, users have sought to attach auxiliary luggage cases or other items to the wheeled main luggage, thereby allowing multiple pieces of luggage to be wheeled about. Known devices for carrying auxiliary items, however, suffer from various drawbacks and disadvantages. For example, conventional luggage straps or hooks may be difficult to attach to the main luggage item, to its associated handle and/or to the auxiliary luggage item, in a manner that is quick, convenient and also secure. It is often time-consuming and cumbersome to deploy the strap in such a way to adequately secure the auxiliary item to the wheeled luggage case.

For attaching auxiliary items to wheeled luggage, straps are known that are nonremovably (i.e., permanently) connected to the article of luggage. Permanent connections distract from the aesthetics of the luggage in that they generally interfere with the smooth, regular, outer contour. Moreover, irregular surfaces on a luggage item make it more difficult to manipulate without snagging other articles or generally becoming tangled in luggage-handling machinery.

It is possible to incorporate a mechanism whereby the strap can be retracted, and thereby minimize potential entanglement. Such retraction mechanisms, such as that of U.S. Pat. No. 5,501,308, increase the costs of making the wheeled luggage device. Also, the additional steps required to deploy such straps from their retracted position have the added inconvenience of potentially requiring extra time for the user to operate, which is especially troublesome if the user is hurrying to make a flight or other time sensitive appointment.

A permanently mounted strap is disclosed in international application PCT/US95/00820, that lacks a retraction mechanism but instead has the corresponding disadvantage of needing a pocket molded into the wheeled suitcase for storing the strap. The strap is attached to the inside of the pocket. Again, the need for a pocket and a strap attachment inside the pocket increases the complexity and cost of manufacturing the wheeled suitcase. The user must go through the inconvenience of storing the strap when not in use, i.e., carefully folding back the strap into the pocket and sealing the pocket to assure that the strap does not inadvertently deploy and snag on other articles or luggage handling equipment, and likewise must reverse the process to deploy the strap.

Wheeled cases have been provided with various structures to enable straps to be removably secured thereto, such as those shown in U.S. Pat. No. 5,323,886 and 5,311,972. These attachment structures disrupt the smooth profile of the wheeled luggage and are prone to be damaged or to snag other articles when the luggage is handled. The location of the attachment points on the suitcase also limits the flexibility available in attaching various types of auxiliary items.

Attachment mechanisms associated with straps also suffer from various drawbacks. An attachment mechanism that is relatively insecure may inadvertently release the strap on one end or the other, allowing the attached item to fall from the wheeled luggage. It is inconvenient and irritating to lose an attached item or to take time to reattach it, especially when time is short. On the other hand, an attachment mechanism that is more secure is likely to take time and attention to operate, which is also inconvenient. What is needed is a balance.

Detachable article retaining straps also may be ill-suited for usage on popular soft-sided luggage items. Inasmuch as the walls of the luggage can be displaced, the attached article and/or the attachment means can move. Displacement of the luggage walls can cause certain types of mounting mechanisms or straps inadvertently to disengage.

A hook is a known mechanism by which to attach an item temporarily to a wheeled suitcase. Known hooks, however, also have certain drawbacks and disadvantages. A known wire hook as in U.S. Pat. No. 5,311,972 presents a large profile which makes storage of the strap and hook difficult. The hook of international application PCT/US95/00820, among other things, requires manual intervention to be deployed. Manual intervention may be inconvenient if the user's hands are devoted to carrying other luggage items.

Accordingly, there is a need for an article for attaching auxiliary items to wheeled luggage free of the drawbacks and disadvantages outlined above.

There is a further need for the article for attaching such auxiliary items to be easy and quick to use yet optimally secure in its attachment.

There is a further need for the attachment article not to disrupt the profile of either the wheeled luggage item or the auxiliary item, and for the manufacture of the article to be simple and cost effective.

SUMMARY OF THE INVENTION

It is an object of this invention to overcome the shortcomings of the prior art by providing an article for securing an item to a suitcase handle which includes an elongated flexible member with a plug attached to one end and a hook attached to another end. The plug is removably insertable into a socket which is mounted to the handle of the suitcase. The hook for receiving the item has two interlinked members which are rotatable with respect to each other between an open position and a collapsed position.

In one version of the invention, one of the interlinked members has an aperture into which the flexible member is slidably received. The flexible member extends through the aperture from the inner surface to the outer surface of the interlinked member. The flexible member extends at least partially along the outer surface of such interlinked member and is secured to the second interlinked member at a location which is laterally spaced from a plane intersecting the aperture. In this way, when the hook is suspended, one of the interlinked members experiences a moment which maintains the hook in the open position.

According to another aspect of the invention, the plug is rotatably received in the socket so that the plug's angular position can be adjusted relative to the handle of the suitcase. When the plug is positioned in a first preselected range of angular positions, an outward longitudinal force will not cause the plug to disengage from the socket. This first angular range is the range normally occupied when the flexible member and hook are deployed for holding an auxiliary item to the luggage item. Thus the attachment is secure. When the plug is positioned in a second preselected range of angular positions, then a sufficient outward longitudinal force will permit disengagement of the plug from the socket. When not deployed for attaching an auxiliary item, the plug can be simply moved into the second angular range and disengaged with a longitudinal tug.

BRIEF DESCRIPTION OF THE DRAWINGS

There is shown in the drawings an exemplary embodiment of the invention as presently preferred. It should be understood that the invention is not limited to the embodiment disclosed and is capable of variation within the scope of the appended claims. In the drawings.

DETAILED DESCRIPTION

Figure 1:
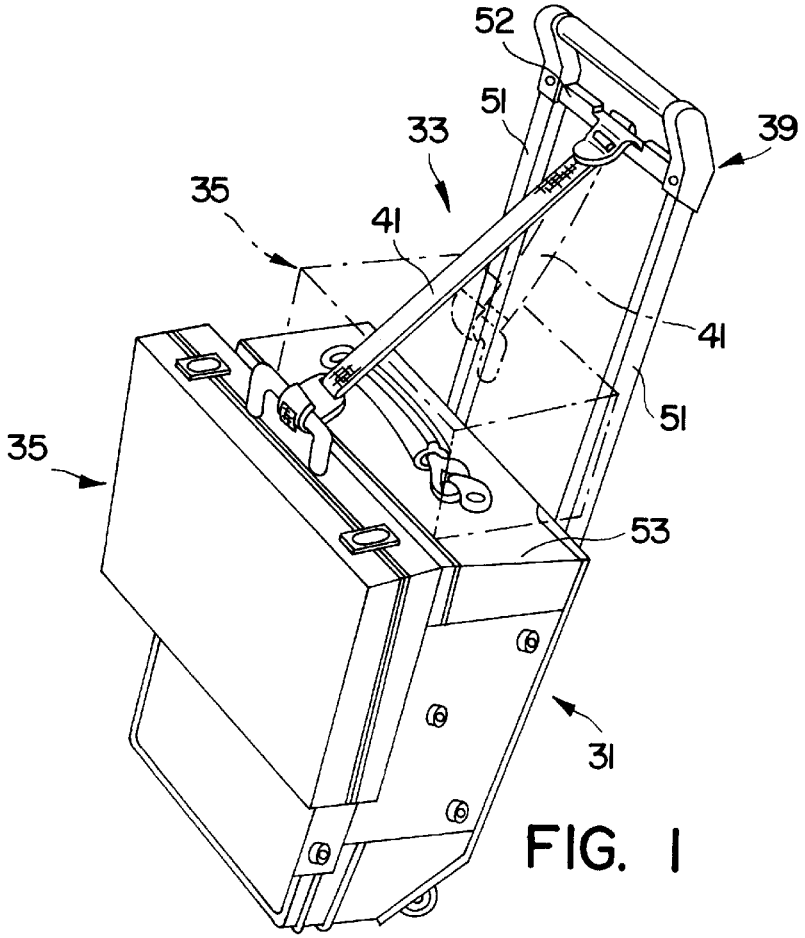
FIG. 1 is a perspective view of an article for attaching an item to a wheeled piece of luggage according to the present invention.

Referring now to the drawings, and in particular to FIG. 1, a suitcase 31 incorporating the principles of the present invention includes an apparatus or article 33 operatively associated with the suitcase 31. The article 33 includes features which allow it to be deployed, adjusted and otherwise operated in conjunction with the suitcase 31 to secure an item 35 to the suitcase 31. The item 35 may be, for example, a briefcase as shown in solid lines in FIG. 1, a strongbox as shown in phantom lines, or any of a variety of other items of various shapes and sizes that people choose to transport.

In this embodiment, handle 39 can be retracted to reside in or against a surface of the suitcase, or extended as shown along rails 51 to a position spaced from the perimeter 53 of suitcase 31 for wheeling the suitcase about. Various specific handle structures are possible for wheeled luggage, and FIG. 1 shows an exemplary type of extendible handle on two spaced rails.

Figure 2:
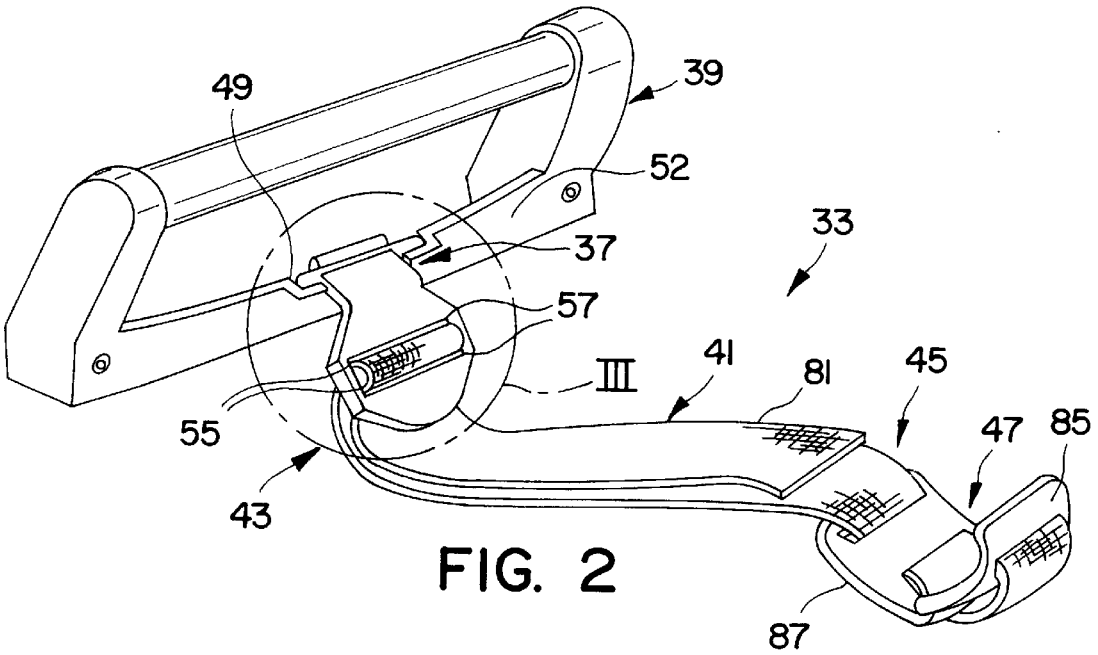
FIG. 2 is a partial perspective view of the article of FIG. 1.

As seen in more detail in the partial view of FIG. 2, which shows the luggage handle 39 and attachment article 33 only, article 33 includes an elongated flexible member 41, typically a nylon or cloth woven strap, which has a plug 37 secured at one end 43 of member 41 and a hook 47 secured at the other end 45 of the member. Plug 37 is removably insertable into a socket 49 disposed on a portion of handle 39.

In general operation, plug 37 is inserted into the socket 49 to affix the proximal end of attachment article 33. Hook 47 is suspended at the opposite or distal end 45 of the flexible member 41, directed toward suitcase 31 and providing an upwardly opening receptacle hook. The auxiliary item 35 is received on hook 47 and retained, for example resting against the surface of the suitcase.

Figure 3:
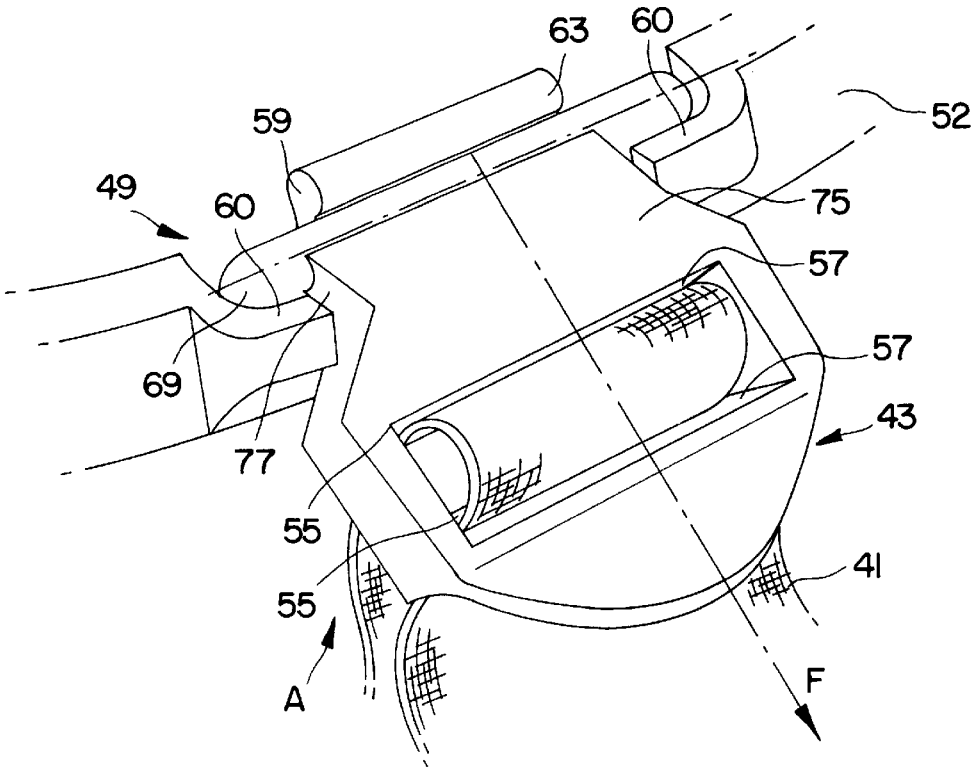
FIGS. 3 and 4 are enlarged perspective views of a portion of the apparatus shown in FIG. 2.
Figure 4:
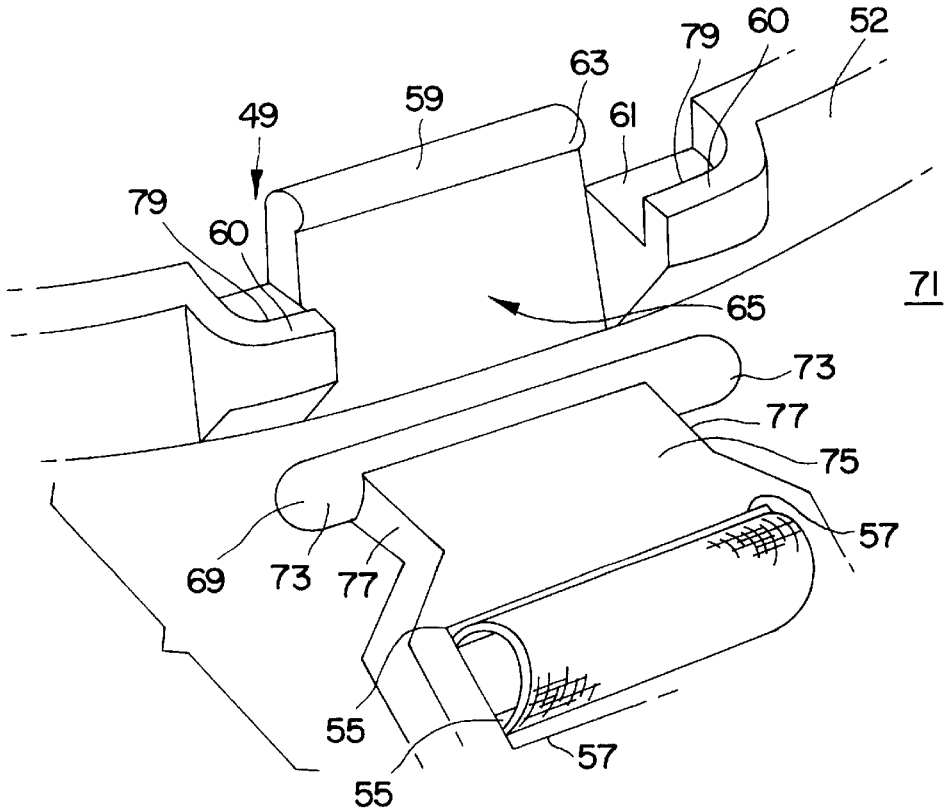
Figure 5:
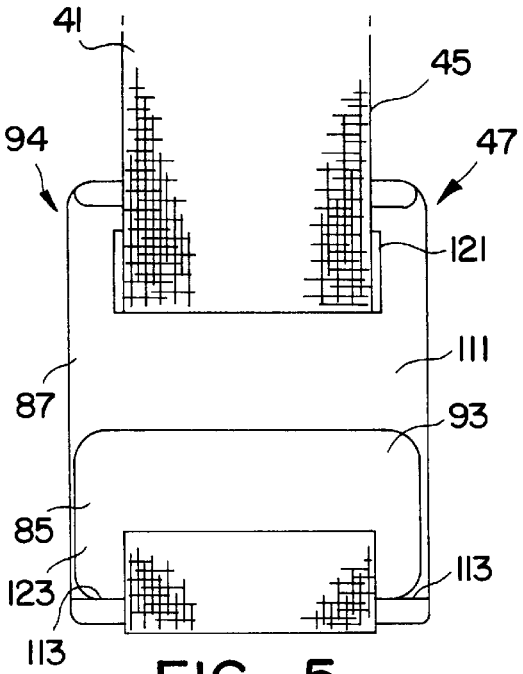
FIG. 5 is a front elevational view of the hook assembly of the apparatus shown in FIGS. 1–4.
Figure 6:
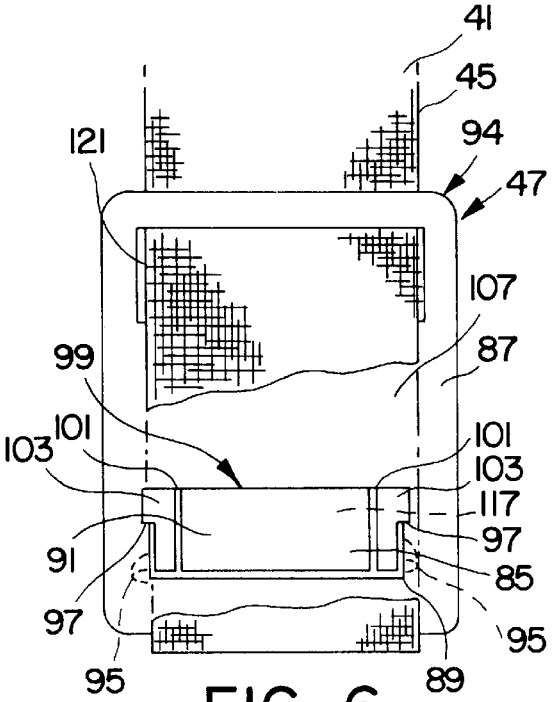
FIG. 6 is a rear, elevational, cutaway view of the hook assembly of FIG. 5.

Referring to FIGS. 3 and 4, plug 37 is rotatably received in socket 49. In this way, the angle of the plug 37 in relation to the handle 39 (FIG. 2) can be adjusted freely by the user. Plug 37 generally extends in the direction in which tension is applied to strap 41. If the strap is adjusted such that the weight of auxiliary item 35 applies tension to the strap, plug 37 extends downwardly as shown in FIG. 3. The angular span of plug 37 allows the flexible member 41 to assume a variety of angular positions when deployed for carrying items 35 of different sizes and in different places, such as those shown in solid and phantom lines in FIG. 1, without substantial risk of accidental disengagement of the plug 37 from the socket 49.

Socket 49 is formed by opposing, substantially parallel walls 59, 60 which define a channel 61 therebetween. The wall 59 terminates in a lip 63 which extends slightly toward the opposing wall 60, inwardly over channel 61. The wall 60 is interrupted by a notch 65.

The plug 37 has a longitudinal axis 67 and a substantially cylindrical flange 69 which extends transversely to the longitudinal axis 67 along a transverse axis of symmetry 71. Plug 37 also includes a neck 75 which extends longitudinally from cylindrical flange 69. The cylindrical flange 69 includes end portions 73 which extend outwardly and transversely from opposite sides 77 of the neck 75.

To engage the plug 37 in the socket 49, the cylindrical flange 69 is inserted past the lip 63 into the channel 61 so that the neck 75 is received within the notch 65. The distance between the forward edge of the lip 63 and the inner surface 79 of the wall 60 is such that a predetermined amount of force is required to snap flange 69 past lip 63 and to be fully received within the channel 61 of the socket 49. In this embodiment, wall 59 is slightly resilient, so the force exerted on the lip 63 causes a slight deflection of the wall 59 to allow the flange 69 to be received within channel 61.

When plug 37 is received in channel 61 and the item 35 is suspended as shown in FIG. 1, an outward longitudinal force is applied to plug 37 in the direction of tension on strap 41, indicated by the arrow F. Whereas portions 73 engage behind wall 60, plug 37 remains quite securely attached and can bear substantial tension if necessary. In this way, end portions 73 and wall 60 cooperate in abutment with one another to prevent disengagement of plug 37 by outward longitudinal force along the strap.

Figure 10:
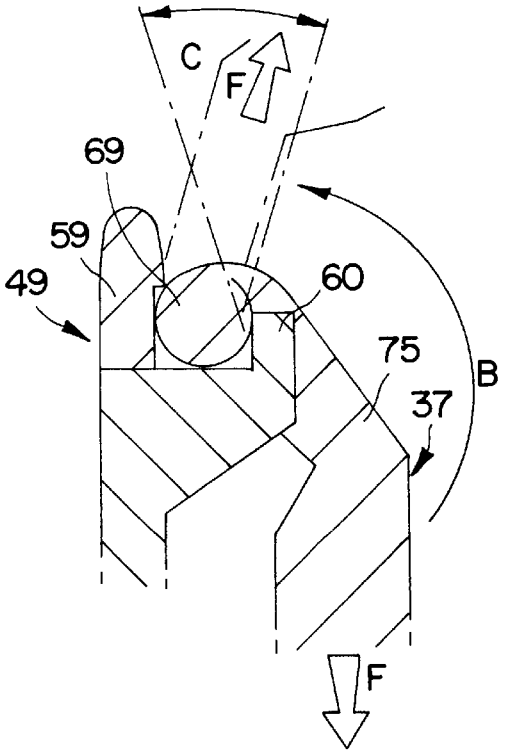
FIG. 10 is a cross-sectional view of the portion of the article shown in FIGS. 3 and 4.

The cooperation of plug 37 and channel 61 prevents detachment of the two by longitudinal force, provided the rotational position of plug 37 is within a certain range of angular positions of plug 37 relative to channel 61. This is the range of positions in which such force urges plug 37 downwardly or forwardly as shown in FIG. 3, corresponding substantially to positions in which neck 75 is wholly or partly in notch 65. Referring more particularly to FIG. 10, so long as the angular position of the plug 37 is within the range of angular positions indicated by the arrow B, if an outward force F is applied, the plug portions 73 abutting wall 60 prevent disengagement of plug 37.

When the angular position of the plug 37 is within the range indicated by C, then the outwardly directed longitudinal force F does not urge end portions 73 to abut wall 60, but rather urges the flange 69 in a direction out of the channel 61. If applied force on the strap is sufficient when plug 37 is in the range C of angular positions, the resilient lip 63 will be deflected and the plug 37 will disengage from the socket 49.

Apart from longitudinal tension on the strap, it is possible for the user to manually grasp neck 75 when in angular range B, and manually to apply an upward force comparable to the force needed to disengage plug 37 by tension on strap 41, and thereby detach plug 37 when neck 75 is in notch 65. However, referring to FIGS. 1 and 10, the range of angular positions B corresponds to the positions which plug 37 would occupy when article 35 is suspended from handle 39 for carrying item 35 in any of the various available positions. In contrast, the range of angular positions C corresponds to the position the plug 37 would assume when the user pivots the plug 37 and the flexible member 41 upwardly in the direction indicated by arrow A in FIG. 3, so as to disengage the plug 37 from the socket 49. This makes the plug very easy and convenient to attach and detach, yet quite secure when in use.

In the embodiment shown, socket 49 is located on cross-beam 52 which extends between rails 51 proximate to hand grip of handle 39. The cross-beam 52 and the socket 49 thereon extend or retract along with handle 39. It would also be possible to mount socket 49 otherwise, for example in closer proximity or even as a part of handgrip 54.

Plug 37 provides a means for adjusting the length of the strap or flexible member 41, such that hook 47 can be located appropriately for the particular item 35 to be carried. Length adjustment slots 55 and corresponding confronting edges 57 (FIGS. 3 and 4) permit the length of the strap to be adjusted by passing the strap through the slots to shorten or lengthen the portion of the strap between hook 47 and slots 55. The strap or flexible member 41 is threaded through the pair of adjusting slots 55 in a known manner to produce a slack free end 81 (FIG. 2) that is longer or shorter depending on the length required between the ends 43, 45 of the flexible member 41.

In this embodiment, the means for adjusting the length of the strap is integral with plug 37. Because the plug 37 attaches at the handle 39, a user's can readily access the adjustment means by hand, especially when the handle 39 is extended as shown in FIG. 1.

Figure 7:
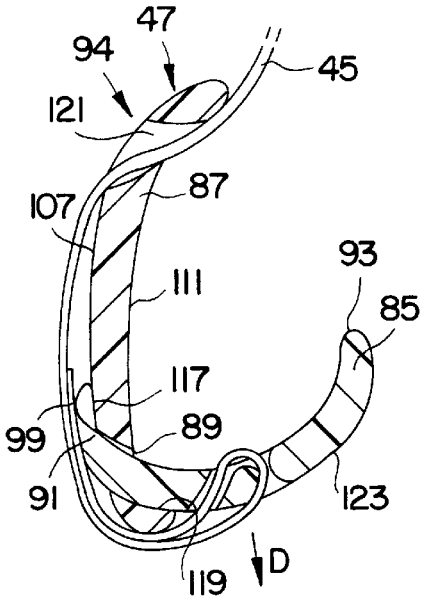
FIG. 7 is a cross-sectional view of the hook assembly of taken along line 7—7 of FIG. 6.

A further aspect of the invention relates to hook 47, best shown in FIGS. 2 and 5–9. The hook 47 comprises a pair of interlinked members 85, 87. The interlinked members 85, 87 are rotatable or pivotable relative to each other between an open position of the hook, for receiving the items thereon as shown in FIGS. 2 and 7, and a collapsed position of the hook, best seen in FIG. 8. Collapsing the hook reduces its size for storage. Interlinked member 87 has a slot 89 defined therein (best seen in FIG. 9) and interlinked member 85 has a tongue 91 extending from one of its ends 93 and received in the slot 89 of its counterpart. Members 85, 87 are interlinked because slot 89 and tongue 91 are relatively sized so that tongue 91 extends loosely through slot 89 when in place. "Loosely" in this context means that a certain amount of relative rotational and translational movement of members 85, 87 is possible while members 85, 87 remain connected or captive with one another.

A pair of surfaces or flanges 95 (of which one is visible in FIG. 9) protrude laterally and outwardly from the base of tongue 91. Another pair of surfaces or flanges 97 protrude laterally and outwardly from tongue 91 at tip 99 thereof. The tongue 91 has a pair of grooves 101 which extend longitudinally, substantially parallel to each other, each groove 101 being located near a side of tongue 91 and extending from tip 99 of the tongue toward the base of the tongue 91. These grooves 101 define tongue portions 103 at opposite sides of the tongue 91. The tongue portions 103 are made of resiliently flexible material and therefore can be deflected laterally and inwardly from the sides of tongue 91. When the tongue portions 103 are deflected inwardly, the width of the tongue 91 is reduced sufficiently to pass tongue 91 through slot 89. When the tongue portions 103 are released, they return to their non-compressed position rendering members 85, 87 captive.

When the tongue 91 is engaged in the slot 89, the flanges 95, 97 keep the members 85, 87 interlinked. Flanges 97 generally engage areas 105 on outer surface 107 of member 87 proximate to slot 89, while flanges 95 generally engage areas 109 (FIG. 8) on an inner surface 111 of member 87 proximate to slot 89. The flanges 95 are longitudinally spaced from the flanges 97 along the sides of the tongue 91, and the tongue 91 is loosely received within the slot 89; therefore, whether flanges 95 or flanges 97 engage member 87 depends on the position of the members 85, 87 relative to each other. The flanges 95, 97 act as limits setting an endpoint of the range of pivoting movement available to members 85, 87 relative to each other.

Figure 8:
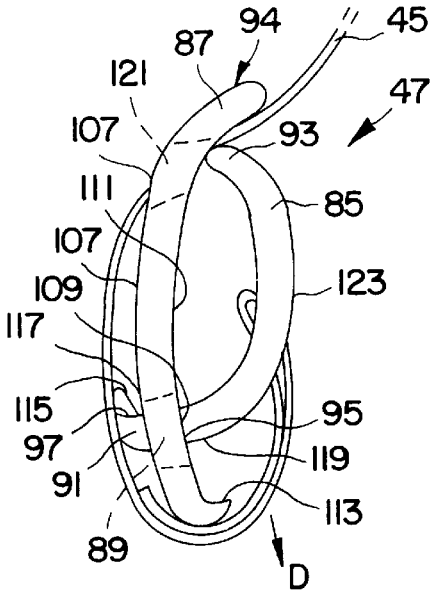
FIG. 8 is a side view showing the hook assembly of FIGS. 5–7 in collapsed position.
Figure 9:
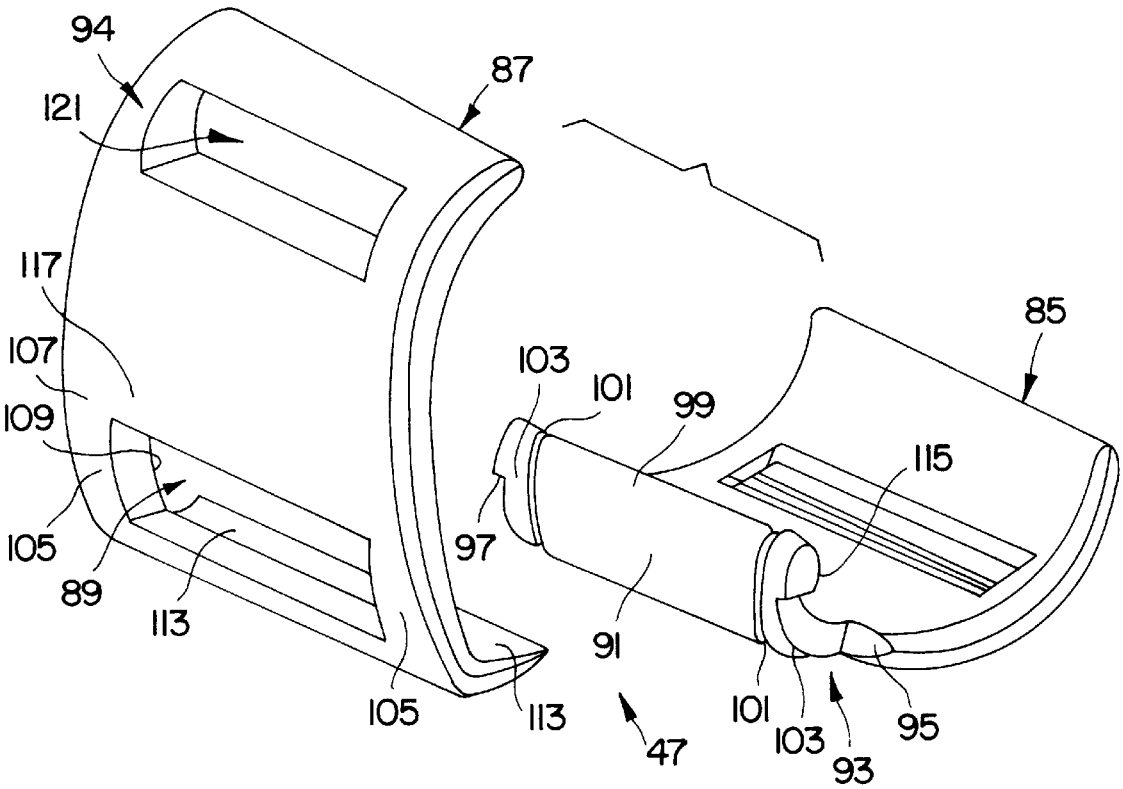
FIG. 9 is an exploded perspective view of the hook assembly of FIGS. 5–8.

The interlinked members 85, 87 of hook 47 likewise have features which prevent the hook 47 from becoming hyperextended. Member 87 has a support surface 113 at the end closest to slot 89 extending therethrough. The tongue 91 on member 85 has a support surface 115 at its tip 91. The support surfaces 113, 115 extend substantially across the width of the respective member 87, 85. When hook 47 is in its fully open position, support surfaces 113, 115 are oriented so that they abut corresponding engagement zones 117, 119, as best seen in FIGS. 7 and 8. The support surface 113 of the member 87 bears against and opposes its corresponding engagement zone 119 located on the member 85 near the tongue 91. At the same time, the support surface 115 of the member 85 bears against and opposes the engagement zone 117 which is located on the member 87 slightly medial of the slot 89 therethrough. This arrangement of the support surfaces 113, 115 and their corresponding engagement zones 119, 117 maintains hook 47 in an open, nonhyperextended position as shown in FIGS. 2 and 5–7, but also permits the hook 47 to assume the collapsed position shown in FIG. 8.

A further inventive aspect involves the connection of hook 47 to the second end 45 of the strap or flexible member 41. Hook member 87 has an aperture 121 located at end 94 of the member 87, longitudinally spaced from slot 89 in which tongue 91 is received. As best seen in FIGS. 5–8, the end 45 of the flexible member 41 is freely slidable in aperture 121, extending from the inner surface 111 of member 87 to the outer surface 107 thereof. The flexible member 41 then extends longitudinally along part of the outer surface 107 of interlinked member 87, past end 96 of member 87. Flexible member 41 then wraps over and is secured to member 85 from its outer surface 123. For example, flexible member 41 is looped back around a cross member provided between two parallel slots in member 85, and sewn such that the flexible member and hook are permanently attached.

Flexible member 41 is secured to the interlinked member 85 at a location which is laterally spaced from a plane which substantially longitudinally intersects aperture 121 in interlinked member 87. In this way, when hook 47 is suspended and even the slight tension of the weight of the hook is applied to flexible member 41, the weight acts to tighten the portion of the flexible member 41 between aperture 121 and member 85. This creates a moment in the direction indicated by arrow D in FIG. 7. This moment causes member 85 to be pulled downwardly or outwardly relative to member 87, and works to maintain hook 47 open. The flexible member 41 is freely slidable in aperture 121 so that, when the hook is suspended, the moment opens hook 47 without requiring manual intervention. In other words, hook 47 opens under its own weight when suspended on flexible member 41. This feature is especially advantageous when the user's hands are full, e.g., with one hand on handle 39 and the other on the handle of the briefcase or other article 35 to be attached. It is not necessary manually to separate members 85, 87 to open hook 47.

The use and operation of attachment article 33 is apparent from the foregoing description. To deploy article 33, plug 37 is snapped into socket 49, and flexible member 41 is extended. When end 45 of flexible member 41 is suspended downwardly, hook 47 opens (if not already open) generally without manual intervention and remains open by virtue of the moment D (FIG. 7). The operative length of the flexible member 41, as well as its angle relative to the handle 39, may be adjusted at any point during usage of the article 33, depending on the size of item 35 and where the user wishes to attach item 35 in relation to the main wheeled luggage case 31. Auxiliary item 35 is appropriately placed on hook 47, for example by setting its handle on the inner surface of member 85 and/or member 87. When carrying a load such as the item 35, tension on flexible member 41 presses flange portions 73 against wall surface 79 of socket 49, which keeps the plug 37 attached to the handle 39.

To detach the attachment article 33 from handle 39, the user may rotate plug 37 relative to handle 39 in direction A (FIG. 3) until it assumes an angular position in the range indicated by C in FIG. 10. In that position, the user merely needs to pull outwardly on the member 41 or the plug 37 to detach it from the socket 49. If desired, the user can apply a force to the plug 37 in a direction out of the slot 61 of the socket 49 to disengage the plug 37, irrespective of its angular position.

Hook 47 may be collapsed by rotating the interlinked members 85, 87 toward each other to assume the position shown in FIG. 8. Of course, the order of the above operations may be varied by the user according to particular preferences and circumstances.

Although the elements of the article 33 of the present invention may be made of a variety of materials, in a preferred embodiment the flexible member 41 is a web of nylon or cloth material and handle 39, plug 37, socket 49, and the interlinked members 85, 87, are formed of a polymeric material which is sufficiently strong to accomplish the purposes of this invention including, among other goals, the attachment and transportation of the item 35 (FIG. 1).

Various alternatives and variations to the embodiment discussed above are also within the scope of the present invention. For example, although the article 33 has a two-part hook 47, the hook 47 may also be comprised of more than two interlinked members. A one-piece, noncollapsible hook may also be provided.

In addition to the advantages apparent from the foregoing description, the article 33 is easy to attach to the main luggage case, and quickly and efficiently deployed so as to secure the auxiliary item to the main luggage case.

In those embodiments where the flexible member 41 is removable, there is the further advantage of not having a permanent, flexible member connection which not only detracts from the aesthetics of the luggage, but may also interfere with the smooth, regular contours of the luggage item and thereby lead to snagging or entanglement with automated luggage handling machinery.

There is also no need for a retraction system to be incorporated into the present invention, nor is there a need for a separate pocket to be molded into the wheeled suitcase.

As a still further advantage, the article 33 permits the auxiliary item to be attached relative to the main luggage item in a variety of different positions.

The hook 47 has the advantage of being collapsible so as to be easily stored. It is also openable without requiring manual interventions, an advantage which becomes especially important when the user is loaded down with other luggage items.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. An article for securing an item to a suitcase handle comprising:

a socket mounted to the handle;

a plug and means for removably inserting the plug into the socket;

an elongated flexible member;

means for adjustably securing the flexible member to the plug;

a hook for receiving the item; and, means for securing the flexible member to the hook;

the plug and the hook being secured at spaced locations along the flexible member to define first and second functional ends of the flexible member;

the hook having first and second members;

means for connecting the second member to the first member to define a pair of interlinked members, the interlinked members having respective inner surfaces movable away from each other to open the hook and toward each other to collapse the hook.

2. The article of claim 1, wherein the connecting means comprises a slot in the first member and a tongue extending from the second member, the tongue being loosely received through the slot, the tongue having a tip, a base, at least one surface at the tip and at least one surface at the base extending laterally and outwardly from the tongue to engage the first member and thereby keep the first and second members interlinked.

3. The article of claim 2, wherein the surfaces comprise a pair of flanges at the base and another pair of flanges at the tip.

4. The article of claim 2, wherein the surfaces at the tip of the tongue are laterally compressible.

5. The article of claim 2, wherein the means for securing the flexible member to the hook comprises an aperture defined in at least one of the interlinked members into which the flexible member is slidably received.

6. The article of claim 5, wherein the interlinked members have outwardly oriented surfaces, the article further comprising means, responsive to suspension of the hook from the second functional end, for applying outwardly directed force to the hook to cause the hook to open.

7. The article of claim 4, wherein the aperture is located in the first interlinked member, and wherein the means for applying outwardly directed force comprises the second end of the flexible member extending through the aperture of the first interlinked member from the inner surface to the outer surface thereof, the second end being secured to the second interlinked member from the outer surface of the second interlinked member and at a location laterally spaced from a plane of the first interlinked member.

8. The article of claim 7, wherein, when the hook is suspended in the open position, the first interlinked member is oriented substantially vertically to form a back and the second interlinked member is oriented substantially horizontally to form a finger, the second interlinked member having a surface adapted to receive the item thereon.

9. The article of claim 7, wherein the second functional end extends longitudinally along at least a portion of the outer surfaces of the interlinked members.

10. The article of claim 1, further comprising means for adjusting the length of the flexible member located at the first functional end thereof, and wherein the hook is fixedly secured at the second functional end, whereby the length of the flexible member can be adjusted without movement of the hook relative to the flexible member.

11. The article of claim 1, wherein the interlinked members have interlinked ends with support surfaces thereon and engagement zones at locations opposed to corresponding ones of the support surfaces, the support surfaces abutting the engagement zones to keep the hook from hyperextending from the open position.

12. The article of claim 1, wherein the means for removably securing the plug into the socket includes walls on the socket defining a channel and a substantially cylindrical flange which is rotatably received in the channel of the socket to permit angular adjustment of the plug in relation to the handle.

13. The article of claim 12, wherein the plug includes a transverse axis and the socket includes means preventing disengagement of the plug by force in a radially outward direction relative to the transverse axis when the plug is positioned within a first preselected range of angular positions, and permitting disengagement by said force over a second preselected range of angular positions.

14. The article of claim 13, wherein said preventing and permitting means comprises a first portion of the plug which engages at least one of the walls to oppose the outward force when the plug is positioned within the first preselected range of angular positions, and which fails to engage the wall when the plug is positioned within the second preselected range to permit disengagement by the outward force.

15. The article of claim 14, wherein the wall includes a notch and the plug includes a second portion which is at least partially received into the notch when the plug is positioned within the first preselected range of angular positions.

16. The article of claim 15, wherein the first preselected range of angular positions includes the angular position corresponding to suspending the hook against the suitcase when the suitcase is in a substantially upright position.

17. An article for securing an auxiliary item to a handle of a wheeled suitcase comprising:

a socket mounted to the handle;

a plug insertable into the socket;

means for permitting angular rotation of the plug in relation to the handle when the plug is inserted therein;

an elongated flexible member;

means for securing the flexible member to the plug;

a hook for receiving the item; and, means for securing the flexible member to the hook;

the plug and the hook being secured at spaced locations along the flexible member to define first and second functional ends of the flexible member;

the hook having first and second members;

means for connecting the second member to the first member to define a pair of interlinked members, the interlinked members having respective inner surfaces movable away from each other to open the hook and toward each other to collapse the hook;

the interlinked members further having outer surfaces, the first interlinked member having an aperture defined therein, the second functional end of the flexible member extending through the aperture from the inner surface to the outer surface of the first interlinked member, the second functional end being secured to the second interlinked member from the outer surface of the second interlinked member and at a location laterally spaced from a plane intersecting the aperture.

18. The article of claim 17, wherein the first interlinked member has a slot therein and the second interlinked member has a tongue extending therefrom, the tongue being loosely received through the slot, the tongue having a tip, a base, at least one surface at the tip, and at least one surface at the base, the surfaces extending laterally and outwardly from the tongue to engage the first interlinked member and thereby keep the members interlinked.

19. The article of claim 18, further comprising means for adjusting the length of the flexible member, the adjusting means being located at the first functional end of the flexible member, wherein the plug is removable from the socket, wherein the hook is fixedly secured at the second functional end, so that the length of the flexible member can be adjusted without movement of the hook relative to the flexible member;

wherein said means for permitting angular rotation comprises a channel in one of the socket and the plug, and a substantially cylindrical flange defined in the other of the socket and the plug, the flange being received in the channel.

20. An article for securing an item to a suitcase handle comprising:

a socket mounted to the handle;

a plug and means for removably inserting the plug into the socket;

means for permitting angular rotation of the plug in relation to the handle when the plug is inserted therein;

an elongated flexible member;

means for securing the flexible member to the plug;

a hook;

means for securing the hook to the flexible member, the hook adapted to retain the item when the hook is suspended from the flexible member;

wherein the plug includes a transverse axis and the socket includes means preventing disengagement of the plug by force in a radially outward direction relative to the transverse axis when the plug is positioned within a first preselected range of angular positions and permitting disengagement by said force over a second preselected range of angular positions.

21. The article of claim 20, wherein the hook has first and second members; the article further comprising:

means for connecting the second member to the first member to define a pair of interlinked members, the interlinked members having respective inner surfaces movable away from each other to open the hook and toward each other to collapse the hook.

22. The article of claim 20, wherein said preventing and permitting means comprises a wall, the plug having a first portion which engages the wall to oppose the outward longitudinal force when the plug is positioned within the first preselected range of angular positions, and which fails to engage the wall when the plug is positioned within the second preselected range to permit disengagement by outward longitudinal force, and wherein said means for permitting angular rotation comprises a channel in one of the socket and the plug, and a substantially cylindrical flange defined in the other of the socket and the plug, the flange received in the channel.

23. The article of claim 22, wherein the wall includes a notch and the plug includes a second portion which is at least partially received into the notch when the plug is positioned within the first preselected range of angular positions, and wherein the first preselected range of angular positions includes the angular position corresponding to suspending the hook against the suitcase when the suitcase is in a substantially upright position.

24. An article for securing an auxiliary item to a handle of a wheeled suitcase comprising:

a socket mounted to the handle, the socket having walls defining a channel;

a plug and means for removably inserting the plug into the socket, the plug including a cylindrical flange rotatably received in the channel of the socket to permit angular adjustment of the plug in relation to the handle;

an elongated flexible member;

means for securing the flexible member to the plug;

a hook for receiving the item;

means for securing the flexible member to the hook;

the plug and the hook being secured at spaced locations along the flexible member to define first and second functional ends of the flexible member;

the hook having a back and a finger, the back having first and second slots defined therein, the flexible member slidably received in the first slot, the finger having a tongue extending therefrom, the tongue being loosely received through the second slot, the tongue having a tip, a base, a pair of flanges at the tip, and a pair of flanges at the base, the flanges extending laterally and outwardly from the tongue, whereby the finger and the back are interlinked and moveable with respect to each other between an open position and a collapsed position, the flanges being laterally compressible; and means for adjusting the length of the flexible member located at the first functional end thereof, and wherein the hook is fixedly secured at the second functional end, so that the length of the flexible member can be adjusted without movement of the hook relative to the flexible member;

wherein the plug includes a transverse axis and the socket includes means preventing disengagement of the plug by force in a radially outward direction relative to the transverse axis when the plug is positioned within a first preselected range of angular positions and permitting disengagement by said force over a second preselected range of angular positions, the first preselected range of angular positions including the angular position corresponding to suspending the hook against the suitcase when the suitcase is in a substantially upright position.

* * * * *